US007882982B2

(12) United States Patent
Stradella et al.

(10) Patent No.: US 7,882,982 B2
(45) Date of Patent: Feb. 8, 2011

(54) INDICATOR FOR A DEVICE FOR DISPENSING A LIQUID OR POWDERY PRODUCT

(75) Inventors: Giuseppe Stradella, Camogli (IT); Fabio Stradella, Camogli (IT)

(73) Assignee: Valois SAS, Le Neubourg (FR)

( * ) Notice: Subject to any disclaimer, the term of this patent is extended or adjusted under 35 U.S.C. 154(b) by 1128 days.

(21) Appl. No.: 11/587,442

(22) PCT Filed: Apr. 25, 2005

(86) PCT No.: PCT/FR2005/050276

§ 371 (c)(1),
(2), (4) Date: Oct. 25, 2006

(87) PCT Pub. No.: WO2005/114563

PCT Pub. Date: Dec. 1, 2005

(65) Prior Publication Data

US 2007/0210102 A1 Sep. 13, 2007

(30) Foreign Application Priority Data

Apr. 29, 2004 (FR) ..... 04 04591
Jul. 30, 2004 (FR) ..... 04 51739

(51) Int. Cl.
*B67D 7/22* (2010.01)

(52) U.S. Cl. ..... 222/38; 222/36; 222/162; 116/309; 116/315; 116/312; 116/285; 235/94 R; 128/200.14; 128/203.15

(58) Field of Classification Search ..... 222/36, 222/38, 162, 402.1, 402.13; 128/200.14, 128/203.15; 116/284, 285, 309, 311, 312, 116/315; 235/94 R
See application file for complete search history.

(56) References Cited

U.S. PATENT DOCUMENTS 5,174,473 A * 12/1992 Marelli ..... 222/38
5,799,651 A 9/1998 Garby et al.
6,164,494 A * 12/2000 Marelli ..... 222/38

FOREIGN PATENT DOCUMENTS

EP 0 480 488 A1 4/1992
WO WO 01/37909 A1 5/2001
WO WO 02/067844 A2 9/2002
WO WO 02/069252 A2 9/2002
WO WO 02/091293 A1 11/2002

* cited by examiner

*Primary Examiner*—J. Casimer Jacyna
(74) *Attorney, Agent, or Firm*—Sughrue Mion, PLLC

(57) ABSTRACT

An indicator for a dispenser device, having an actuator element (1) displaceable between a rest position and an actuated position, a rotary counter element (5), and a drive element (6) that transforms an axial displacement of the actuator element into a rotary displacement of the counter element (5). The counter element (5) including a set of teeth (9) that co-operate with a resilient mechanism (7, 8) of the drive element (6). The resilient mechanism (7, 8) having two flexible tabs (7, 8), a first flexible tab (7) co-operating with the teeth (9) causing the counter element (5) to turn in a counting direction while the actuator element (1) is displaced towards its actuated position, and a second flexible tab (8) co-operating with the teeth (9) causing the counter element to turn in the same counting direction while the actuator element (1) returns to its rest position.

20 Claims, 7 Drawing Sheets

INDICATOR FOR A DEVICE FOR DISPENSING A LIQUID OR POWDERY PRODUCT

FIELD OF INVENTION

The present invention relates to an indicator, and more particularly to a dose indicator for indicating to the user the number of doses that have been dispensed or that remain to be dispensed from a powder or fluid dispenser device.

BACKGROUND

The use of a counter or of an indicator is well known in the field of fluid dispensers, in particular in the pharmaceutical field. In particular, when such counters or indicators are used with dispenser devices of the Metered Dose Inhaler (MDI) type, in which a reservoir containing fluid and a propellant gas is mounted displaceably in a body, with the displacement of said reservoir causing a metering valve mounted on said reservoir to be actuated so as to dispense one dose, said indicator is constrained in several ways. Firstly, in order to avoid any risk of under-counting, it is generally necessary for the counter to be actuated before or at the beginning of the actuation stroke of the valve or of the pump, so as to avoid any partial actuation that dispenses a partial or a complete dose, but that is not counted by the indicator. In this event, the problem that is posed is that the stroke is generally very short, and that the tolerances of the device tend to reduce even further the effective distance available in order to perform the actuation. This generally requires the use of a complex mechanism in order to provide counting that is functional and certain. In addition, in order to provide a counter that is effective and reliable in operation, in particular when said counter includes a rotary counter element, pawls or similar systems that prevent the counter from turning in the reverse direction are generally provided, thereby also increasing the complexity of the device as a whole.

NON-LIMITING OBJECTS OF THE INVENTION

An object of the present invention is to provide an indicator, and more particularly a dose indicator for a powder or fluid dispenser device, that does not have the above-mentioned drawbacks.

In particular, an object of the present invention is to provide such an indicator that guarantees actuation of the counter regardless of the length of the actuation stroke of the pump or of the valve used in the device.

Another object of the present invention is to provide such an indicator that does not require a complex pawl system or the like in order to prevent one or more elements of the counter from turning in the reverse direction.

Another object of the present invention is to provide such an indicator that is simpler, and thus less costly to manufacture and to assemble, and that is more reliable in operation.

The present invention thus provides an indicator for a powder or fluid dispenser device, said indicator comprising an actuator element that is axially displaceable between a rest position and an actuated position, a rotary counter element, and a drive element, said drive element transforming an axial displacement of said actuator element into a rotary displacement of said counter element, said counter element including a set of teeth that co-operate with resilient means of said drive element, said resilient means comprising at least two flexible tabs, with at least a first flexible tab co-operating with said set of teeth of the counter element, so as to cause said counter element to turn in a counting direction while the actuator element is being displaced from its rest position towards its actuated position, and at least a second flexible tab co-operating with said set of teeth of the counter element, so as to cause said counter element to turn in the same counting direction while the actuator element is returning from its actuated position to its rest position.

Advantageously, said drive element is prevented from turning relative to said actuator element, such that while the actuator element is being displaced axially towards its actuated position, it deforms said resilient means, and while the actuator element is returning axially to its rest position, said resilient means return resiliently to their non-deformed shape.

Advantageously, the resilient means comprise a first flexible tab that pushes a respective tooth of the set of teeth of the counter element on each actuation, and a second flexible tab that pulls on a respective tooth of the set of teeth of the counter element on each actuation.

Advantageously, each tooth of the set of teeth comprises an abutment surface, and a sloping surface, which, at one end, is connected to said abutment surface, and which, at its other end, is connected to the abutment surface of the next tooth of the set of teeth.

Advantageously, while the actuator element is being displaced axially towards its actuated position, it resiliently deforms said first flexible tab having a free end that co-operates with the abutment surface of one of the teeth of the set of teeth, so as to turn said counter element by pushing it, said second flexible tab also being resiliently deformed, with its free end sliding along the sloping surface of another one of the teeth.

Advantageously, while the actuator element is returning axially from its actuated position to its rest position, said second flexible tab returns resiliently to its non-deformed position, with its free end co-operating with the abutment surface of the tooth that is situated circumferentially after the sloping surface of said other tooth, so as to turn said counter element by pulling it, said first flexible tab also returning resiliently to its non-deformed position, with its free end sliding over the sloping surface of the said one tooth, so as to become positioned, in the rest position of the actuator element, in the tooth that is situated circumferentially after the sloping surface of the said one tooth.

Advantageously, the free end of the first flexible tab includes a point for pushing against the abutment surfaces of the teeth of the set of teeth, and the free end of the second flexible tab includes a hook for pulling on the abutment surfaces of the teeth of the set of teeth.

Advantageously, the teeth of the set of teeth co-operating respectively with said flexible tabs are substantially diametrally opposite around the set of teeth.

Advantageously, the counter element is a disk including indicator means that co-operate with a viewing window provided in the actuator element.

In a first embodiment of the invention, the axis of rotation of said counter element is parallel to the displacement axis of said actuator element.

Advantageously, said indicator is fastened on the bottom of a reservoir of a powder or fluid dispenser device, so as to indicate to the user the number of doses that have been dispensed or that remain to be dispensed from said reservoir.

In a second embodiment of the invention, the axis of rotation of said counter element is perpendicular to the displacement axis of said actuator element.

Advantageously, said indicator is formed on a lateral side of a body of a powder or fluid dispenser device, so as to indicate to the user the number of doses that have been dispensed or that remain to be dispensed from said reservoir.

Advantageously, said actuator element is made integrally with said drive element.

In a variant embodiment of the invention, said first and second flexible tabs can flex perpendicularly to the axial displacement of said drive element.

Advantageously, the drive element is disposed so as to be axially displaceable in a body, along a longitudinal axis of said body, and abutment means are provided so as to define an abutment for the axial displacement of said drive element.

Advantageously, the drive element includes an elastically-deformable portion supporting the actuator element, such that said actuator element is axially displaceable over a greater distance than the remainder of the drive element.

Advantageously, said body includes shoulders that co-operate with resilient means of the drive element, said resilient means forming a return spring for the drive element.

Advantageously, said indicator includes guide means that co-operate with an axial extension of the drive element, so as to guide it while it is being axially displaced relative to said body.

The present invention also provides a powder or fluid dispenser device comprising a reservoir, a dispenser member, such as a metering valve, mounted on said reservoir, and a body incorporating a dispenser orifice, said reservoir being displaceable in said body so as to dispense the powder or fluid, said device including an indicator as described above.

In a first variant embodiment, said indicator is fastened on the bottom of the reservoir remote from said dispenser member, the device being actuated by the user manually exerting axial pressure on the actuator element of the indicator, so as to displace said reservoir relative to said body.

Advantageously, the indicator is actuated, at least in part, before any displacement of the reservoir in the body.

Advantageously, a first stage of the actuation cycle of the indicator is performed before any displacement of the reservoir in the body, and a second stage of the actuation cycle of the indicator is performed while the reservoir is returning to its rest position, such that the indicator is not actuated while powder or fluid is being dispensed.

In a second variant embodiment, said indicator is fastened on the side of the body, with said device being actuated by the user manually exerting axial pressure on the reservoir, and with said indicator being actuated by said axial displacement of said reservoir that co-operates with said actuator element of the indicator.

Advantageously, the indicator is actuated, at least in part, before any powder or fluid is dispensed by said dispenser member.

Advantageously, a first stage of the actuation cycle of the indicator is performed before any powder or fluid is dispensed, and a second stage of the actuation cycle of the indicator is performed after powder or fluid has been dispensed, such that the indicator is not actuated while powder or fluid is being dispensed.

BRIEF DESCRIPTION OF THE DRAWINGS

Other characteristics and advantages of the present invention appear more clearly from the following detailed description, given by way of non-limiting example, and with reference to the accompanying drawings, and in which:

FIGS. 7 to 17 are diagrammatic views showing an actuation cycle of the indicator constituting a particular embodiment of the present invention, with FIGS. 7 to 11 showing one side of the indicator, while FIGS. 12 to 17 show the opposite side of the indicator;

FIGS. 26 to 36 are diagrammatic views showing an actuation cycle of the indicator of FIGS. 21 to 25, with FIGS. 26 to 30 showing one side of the indicator, while FIGS. 31 to 36 show the opposite side of the indicator.

DETAILED DESCRIPTION OF NON-LIMITING PREFERRED EMBODIMENTS

Figure 1:
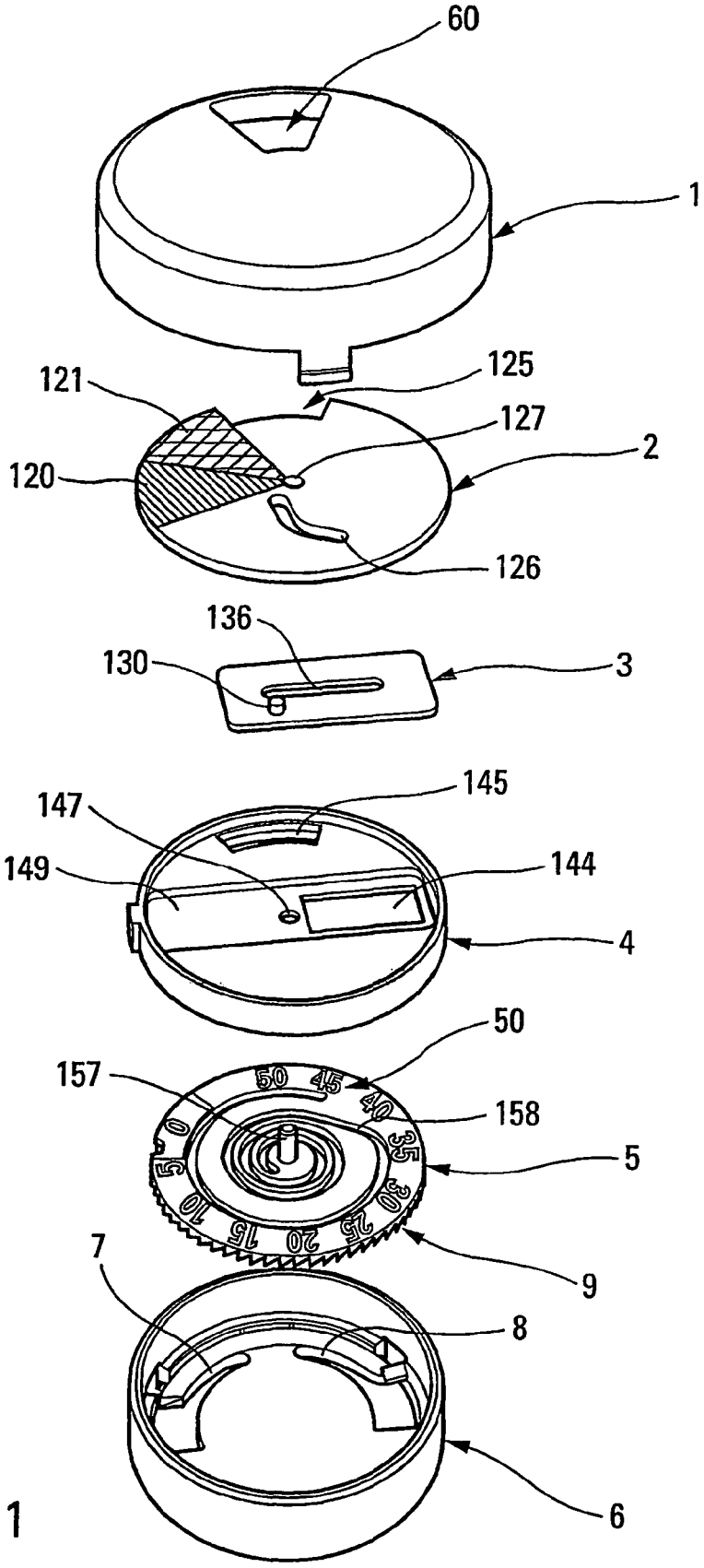
FIG. 1 is an exploded perspective view of an indicator constituting a particular embodiment of the present invention.

FIG. 1 is an exploded view showing a dose indicator or counter that corresponds to a particular embodiment of the present invention. Naturally, this embodiment is described only by way of example, and various elements of the indicator could be made differently. More precisely, the present invention relates to the actuator means that make it possible to actuate said counter, and naturally the indicator means could be of any type, and are not limited to the indicator means shown in the drawings.

More precisely, the indicator of the invention comprises at least a counter element 5, an actuator element 1, and a drive element 6. The actuator element 1 is axially displaceable, preferably in translation, and the counter element 5 is mounted to turn about said displacement axis of the actuator element 1. The drive element 6 is provided so as to transform the axial displacement of the actuator element 1 into a rotary displacement of the counter element 5.

Figure 5:
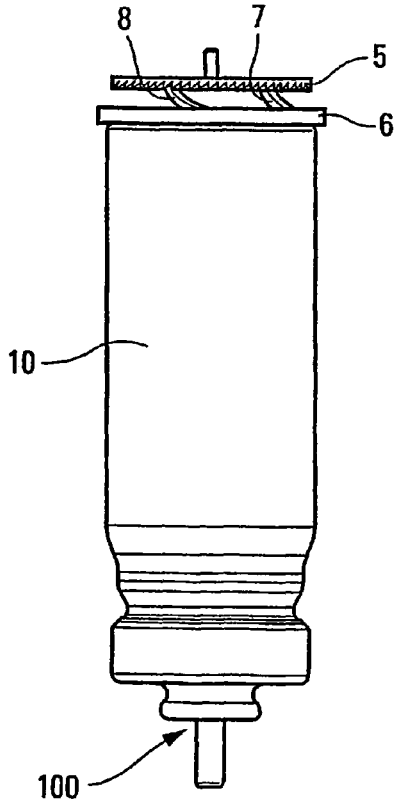
FIG. 5 is a fragmentary and diagrammatic view of an indicator assembled on the bottom of a reservoir.

It should be observed that in the embodiment in FIG. 5 (and in FIGS. 18 to 20), the indicator is assembled on the bottom of a reservoir 10, in which event the actuator element 1 (not shown in FIG. 5) can be similar to the indicator element shown in FIG. 1. The counter element 5 is then displaced towards said drive element 6. In contrast, in the embodiment shown in FIG. 6, in which the indicator is mounted on the side of a reservoir 10, the actuator element 1 can be formed by a projection 1, for example, that is spherical at least in part, and that is secured to the drive element 6. While said reservoir 10 is being displaced vertically downwards in the configuration shown in FIG. 6, the projection 1 causes said drive element 6 to be axially displaced towards the counter element 5.

In both configurations shown above in FIGS. 5 and 6, the actuator element 1 and the drive element 6 are constrained to turn together, and the drive element 6 includes resilient or flexible means 7, 8 that are adapted to transform an axial displacement of the actuator element 1 and/ or of the drive element 6 into a turning movement of the counter element 5.

In the embodiment shown in FIG. 1, the indicator includes a cover element forming the actuator element 1, which cover element can be provided with a viewing window 60. An indicator disk 2, a drive plate 3, and a guide disk 4 can be interposed between said actuator element 1 and said counter element 5.

The indicator disk 2 can include colored or similar sectors 120; 121, and a window 125 that is disposed in register with the viewing window 60 of the actuator element 1. A guide rail 126 and a central hole 127 can also be provided in said indicator disk 2. In addition, the drive plate 3 can support a first drive pin 130 that is engaged in the guide rail 126 of the indicator disk 2, and a second drive pin (not shown) that is positioned on the opposite side of said drive plate. The drive plate can also be provided with a linear window 136. Finally, the guide disk 4 can be provided with a window 145 that matches the window 60 of the actuator element 1, a central hole 147, a linear guide seat 149 that is adapted to receive the drive plate 3, and an opening 144 through which there can pass the bottom drive pin (not shown) of the plate 3. All of the elements are then assembled on a central pin 157 provided on the counter element 5, said counter element also including a profile or rail 158 that is spiral-shaped at least in part, and that is adapted to co-operate with the bottom guide or drive pin (not shown) of the drive plate 3. In this embodiment, and by way of example, it is possible to provide two hundred doses in the reservoir, the first one hundred and fifty doses being shown in the viewing window 60 by means of the two sectors 120, 121 of the indicator disk. Initially, when the sector 120 is completely in the viewing window 60, this means that the reservoir is full. Then, progressively, as the doses are dispensed, the indicator disk 2 turns, and the sector 121 progressively takes up the place of the sector 120 in the viewing window 60. The indicator disk 2 is turned by means of the counter element 5, which, by turning, drives the drive plate 3 in translation in its guide seat 149 as a result of the bottom drive pin (not shown) co-operating with the spiral-shaped portion of the rail 158. The translation movement of the drive plate 3 causes the indicator disk to turn as a result of the co-operation between the top pin 130 and the guide rail 126. Finally, when no more than fifty doses remain in the reservoir, the drive plate 3 reaches its end position, and it is the indicator means 50, or more precisely the numbers shown on the counter element 5, that then appear in the windows 60 and 125 of the actuator element 1 and of the indicator disk 2. Then, since the profile 158 is thus substantially circular, subsequent actuations of the indicator no longer cause the indicator disk 2, nor the drive plate 3 to be displaced, and only the counter element 5 turns inside the actuator element 1, thereby causing numbers to be counted down progressively, representing the number of doses that remain inside the reservoir. Naturally, this relates to a particular embodiment, and any other indication method can be envisaged, whether it be for indicating the number of doses that have been dispensed from the reservoir, or the number of doses that remain to be dispensed therefrom.

Preferably, the actuator element 1 is snap-fastened inside the drive element 6 so as to avoid the indicator being disassembled, and in this event, the actuator element 1 can slide axially inside said drive element 6. Once again, this is only one embodiment, and the various elements could be made to co-operate differently.

In the invention, the counter element 5, that is preferably made in the form of a thin disk, includes, on one side, the indicator means 50 that are for viewing through the viewing window 60 provided in the cover 1, and, on the other side, a set of teeth 9 for co-operating with the resilient means 7, 8 of the drive element 6. The resilient means comprise at least two flexible tabs. At least one first flexible tab 7 co-operates with said set of teeth 9 of the counter element 5 while the actuator element 1 is being displaced from its rest position towards its actuated position. This results in said counter element 5 being turned in a counting direction. The resilient means of the drive element 6 also comprise at least one second flexible tab 8 that co-operates with said set of teeth 9 of the counter element 5, so as to cause said counter element 5 to turn in the same counting direction while the actuator element 1 returns from its actuated position to its rest position. In other words, the actuation cycle of the indicator is divided into two distinct stages, a first stage that is performed while the actuator element is being displaced away from its rest position towards its actuated position, and a second stage that is performed while the actuator element is returning from its actuated position to its rest position.

Figure 2:
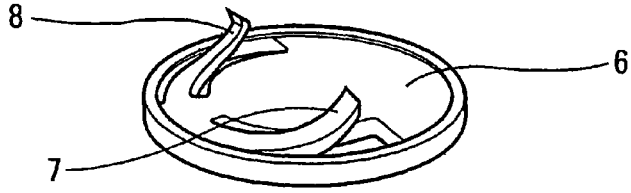
FIG. 2 is a diagrammatic perspective view of a variant embodiment of the drive element of the indicator shown in FIG. 1.
Figure 3:
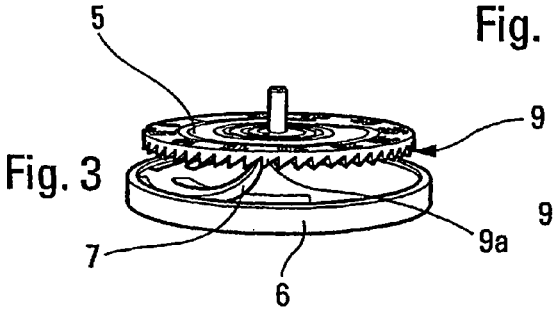
FIG. 3 and FIG. 4 are two diagrammatic perspective views showing the interaction between the counter element and the drive element, as seen from two opposite viewing angles.
Figure 4:
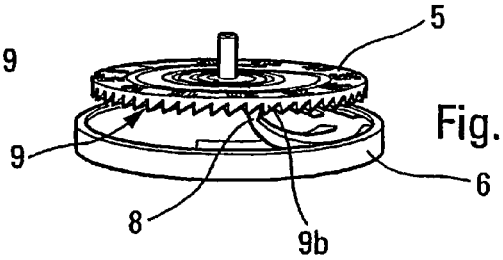
Figure 7:
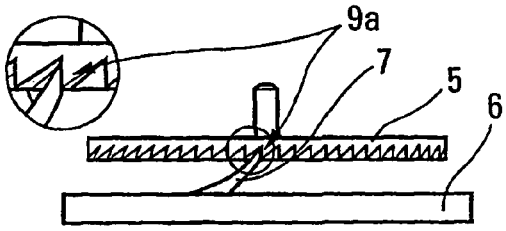
Figure 16:
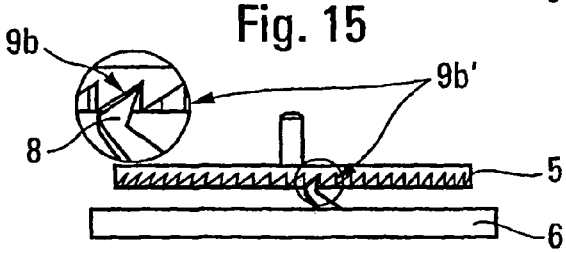
Figure 17:
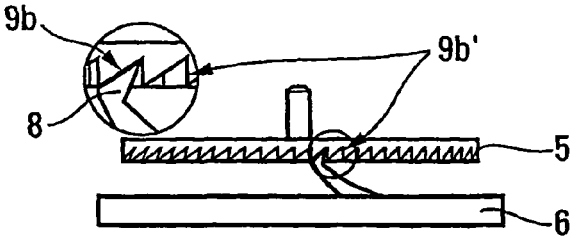

FIGS. 2, 3, and 4 show more precisely said flexible tabs 7 and 8 of the drive element 6. Naturally, even though there is only one first flexible tab 7 and only one second flexible tab 8 in the embodiment shown, any number of tabs could be envisaged, and the tabs need not necessarily be diametrally opposite as in the embodiment shown. As can be seen in FIGS. 2 to 4, the first flexible tab 7 advantageously includes a free end that is approximately in the shape of a point, whereas the second flexible tab 8 advantageously includes a free end that is approximately in the shape of a hook. FIG. 3 shows how the first flexible tab 7 co-operates with the set of teeth 9 of the counter element 5, i.e. its free end comes to co-operate with a tooth 9*a* of said set of teeth. Similarly, FIG. 4 shows the co-operation between the second flexible tab 8 and the same set of teeth 9, in which event the free hook-shaped end of the second flexible tab 8 co-operates with a tooth 9*b* of the set of teeth 9 of the counter element 5. Advantageously, each tooth of the set of teeth 9 comprises an abutment surface, and a sloping surface which connects said abutment surface to the abutment surface of the tooth that is directly adjacent in said set of teeth 9. Thus, while the user is actuating the actuator element 1, said actuator element is displaced axially relative to the drive element 6, without turning relative thereto, such that it resiliently compresses or deforms the flexible tabs 7 and 8. Deforming the first flexible tab 7 thus causes the counter element 5 to turn, as described below with reference to FIGS. 7 to 9. While the actuator element 1 is returning to its rest position, the two tabs 7 and 8 return resiliently to their non-deformed positions, and during this movement the second flexible tab 8 co-operates with the set of teeth 9, so as to cause the counter element 5 to turn likewise in the same counting direction as the direction imparted thereto by the first flexible tab 7 during the first stage of the actuation cycle. The second stage of the actuation cycle is shown more precisely in FIGS. 15 to 17.

Reference is made below more precisely to FIGS. 7 to 17, in which FIGS. 7 to 11 are diagrammatic views showing the interaction between the first flexible tab 7 and the set of teeth 9 of the counter element 5 during one complete actuation cycle of the counter, and similarly FIGS. 12 to 17 show the co-operation between the second flexible tab 8 and the same set of teeth 9 of the counter element 5 during the same complete counting cycle of the indicator. The figures that are situated side-by-side show the two flexible tabs 7 and 8 at the same moment during the same actuation cycle.

Figure 12:
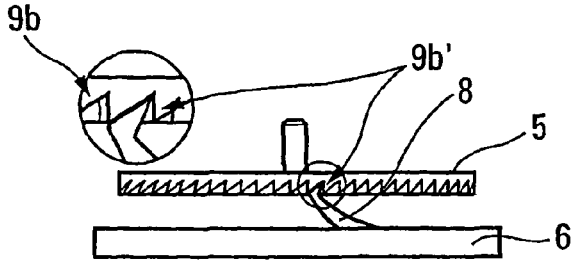
Figure 8:
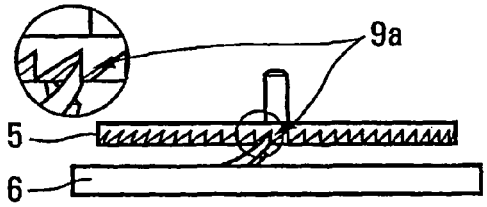
Figure 13:
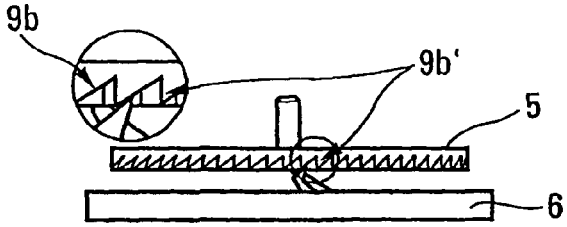
Figure 9:
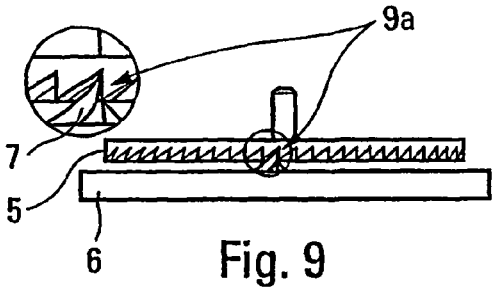
Figure 14:
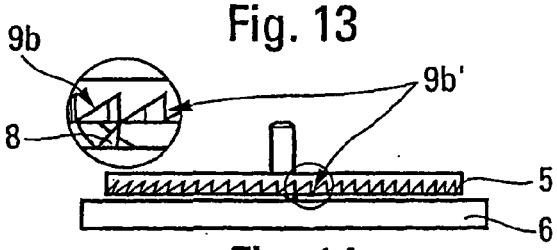
Figure 10:
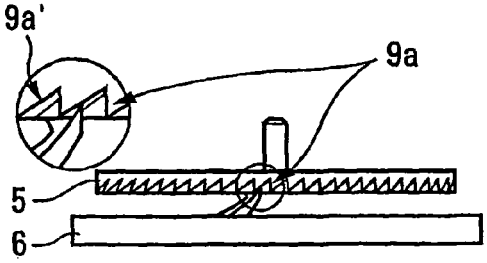
Figure 11:
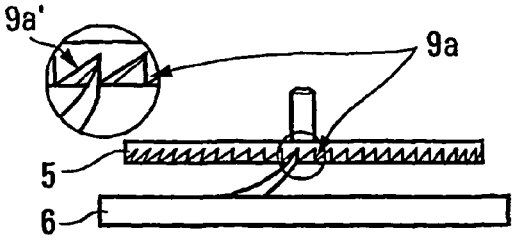

More clearly, at the beginning of the actuation cycle, while the user is displacing the actuator element 1 from its rest position towards its actuated position, the free end of the first flexible tab 7 is situated facing an abutment surface of one of the teeth 9*a* of the set of teeth 9. As shown in FIGS. 8 and 9, as the actuator element 1 is displaced towards its actuated position, the counter element 5 moves axially towards the drive element 6, causing the first flexible tab 7 to deform resiliently, said first flexible tab thus pushing against the abutment surface of the said one tooth 9*a*, thereby causing the counter element 5 to turn about the axis of rotation. Simultaneously, and as can be seen in FIGS. 12 to 14, the advantageously hook-shaped free end of the second flexible tab 8 slides along a sloping surface of a tooth 9*b*' that is situated immediately next to another one of the teeth 9*b* of the set of teeth 9. In particular, with reference to FIGS. 12 to 14, it should be observed that the counter element 5 progressively moves towards the drive element 6, thereby causing the second flexible tab 8 to deform resiliently, and consequently causing its free end to slide over the sloping surface. Once the position in FIG. 14 has been reached, as can be seen more clearly in the larger-scale small detail in FIG. 14, the edge of said hook-shaped free end of the second flexible tab 8 passes from the sloping surface of the tooth 9*b*' to the abutment surface of the said other tooth 9*b*. Passage between FIG. 14 and FIG. 15 takes place automatically by means of the elasticity of the second flexible tab 8 that is deformed by actuating the actuator element 1. From then on, while the free end of the second flexible tab 8 is situated inside the said other tooth 9*b*, while the actuator element is returning from its actuated position to its rest position, the counter element 5 progressively moves axially away from the drive element 6, thereby automatically enabling the second flexible tab (and the first flexible tab 7) to return resiliently into its original non-deformed position. During this process, and as shown clearly in FIGS. 15 to 17, the free end of the second flexible tab 8 co-operates with the abutment surface of the said other tooth 9*b* so as to turn said counter element 5 by pulling it about said axis in the same counting direction as before. Simultaneously, and as can be seen in FIGS. 10 and 11, the free end of the first flexible tab 7 slides along the sloping surface of the said one tooth 9*a*. Finally, when the actuator element is in its rest position, the first flexible tab 7 becomes positioned inside the tooth 9*a*' that is adjacent to said sloping surface of the said one tooth 9*a*, the indicator then being ready for another actuation cycle.

The indicator as described above presents numerous advantages. Thus, in particular, it does not require any pawl system or the like in order to prevent the counter element 5 from turning in the reverse direction opposite to the direction imparted thereto by the two flexible tabs 7 and 8. Each time one of the two flexible tabs 7, 8 slides along a sloping surface of a tooth, which could cause the counter element to be displaced by friction in the reverse direction, the other flexible tab causes the counter element to turn in the counting direction, thereby overriding the effect of said possible friction.

Figure 15:
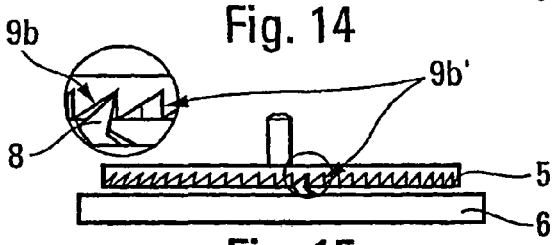
Figure 20:
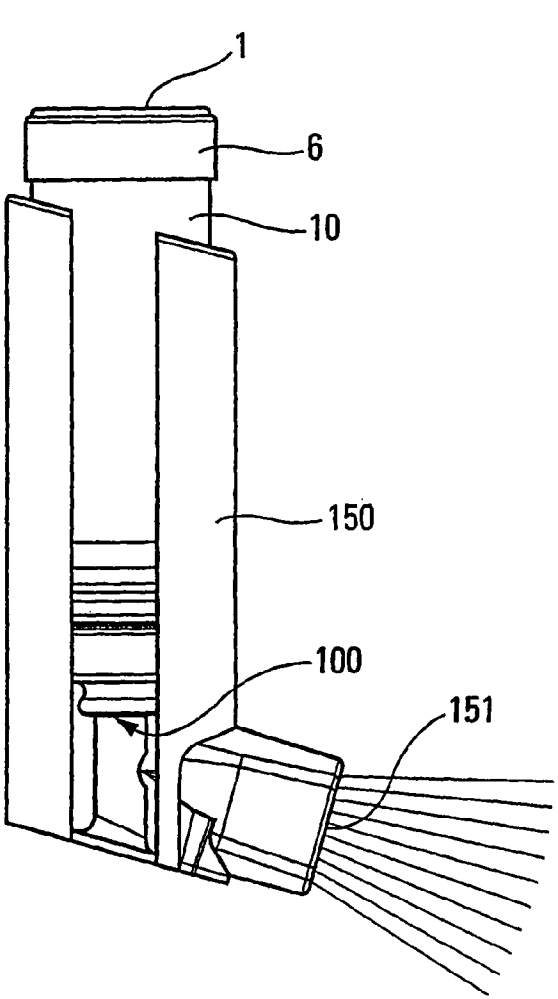
FIGS. 18 to 20 diagrammatically show a fluid dispenser device including an indicator constituting an advantageous embodiment of the invention, during the first stage of an actuation cycle.
Figure 19:
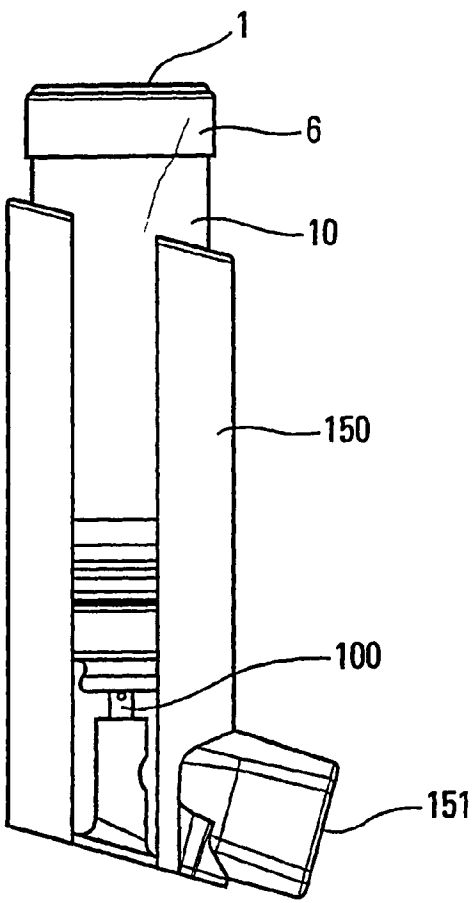
Figure 18:
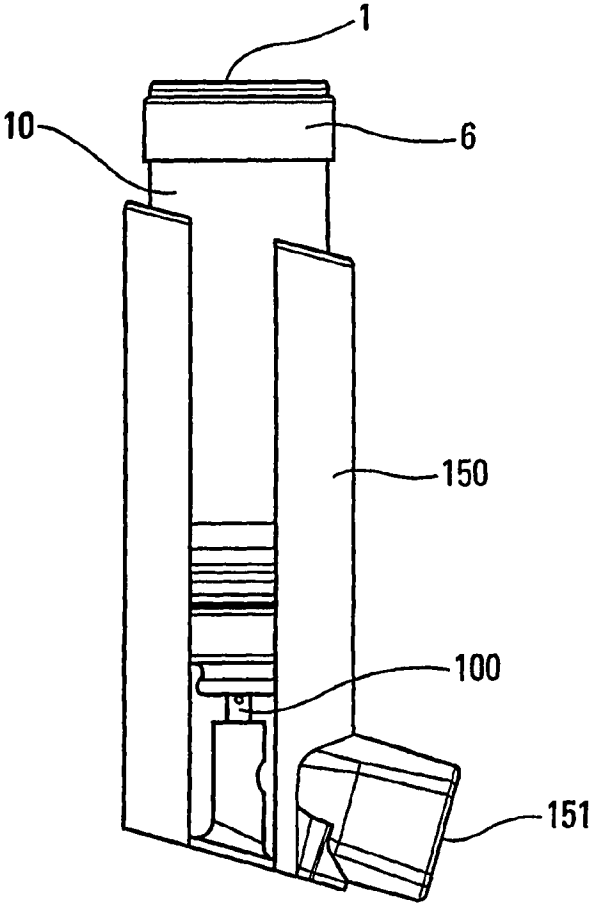
Figure 21:
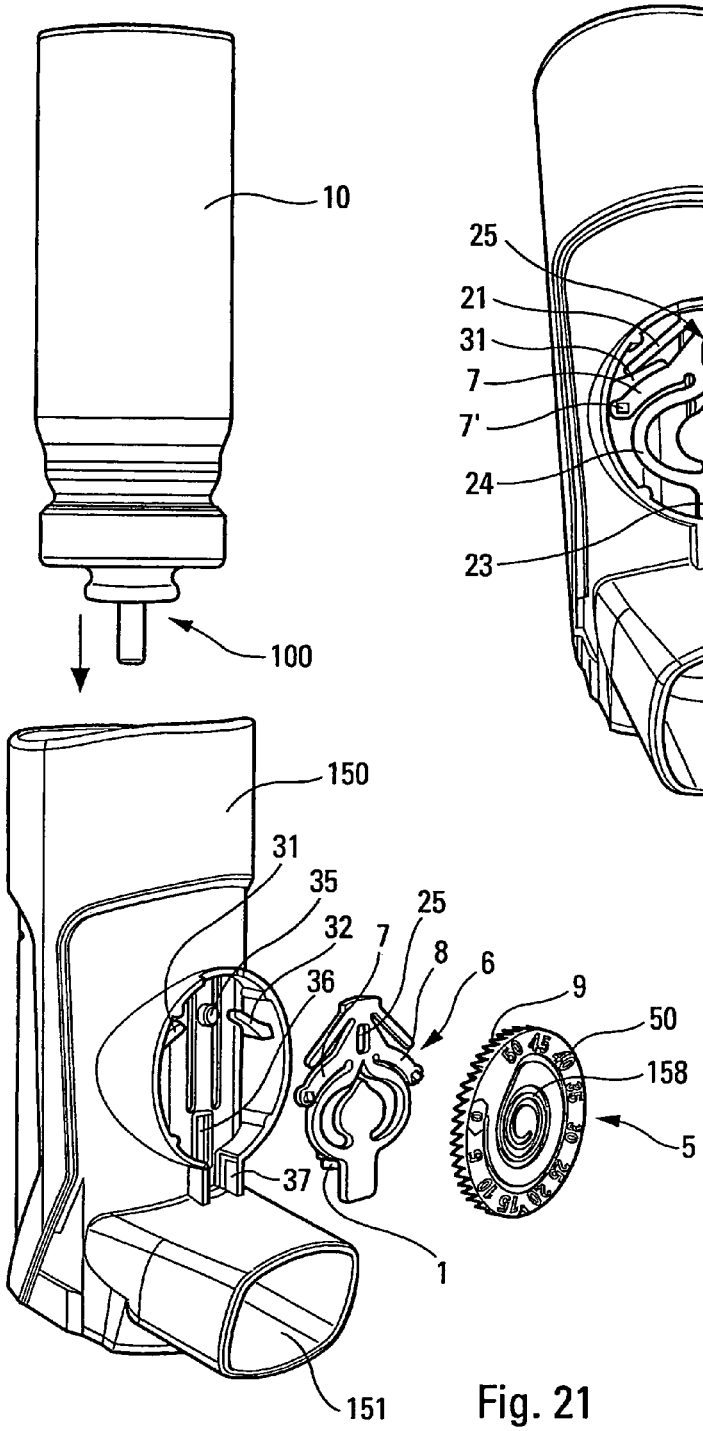
FIG. 21 is an exploded fragmentary view of a dispenser device including an indicator constituting another embodiment of the invention.

In addition, in a first variant embodiment shown in FIGS. 18 to 20, i.e. with the indicator disposed on the bottom of the reservoir .10, the first stage of the actuation cycle that corresponds to the actuator element passing from its rest position towards its actuated position can be performed before any displacement of the reservoir 10 inside the body 150 of the inhaler. This applies from the moment when the resistance to deformation of the flexible tabs 7, 8 of the indicator is less than the resistance to deformation of the metering valve 100. Consequently, the actuation cycle begins before the actuation stroke of the valve (or of the pump) 100 begins, thereby eliminating any risk of under-counting. As soon as the actuator element 1 arrives in its actuated position, continuation of the pressure exerted by the user on the actuator element 1 causes the reservoir 10 to be displaced, and as soon as this displacement begins, the free end of the second flexible tab 8 passes from the tooth 9*b*' to the said other tooth 9*b*, as shown in FIGS. 14 and 15, consequently guaranteeing that the complete counting cycle of the indicator is terminated even if the valve (or pump) is activated only partially.

Figure 6:
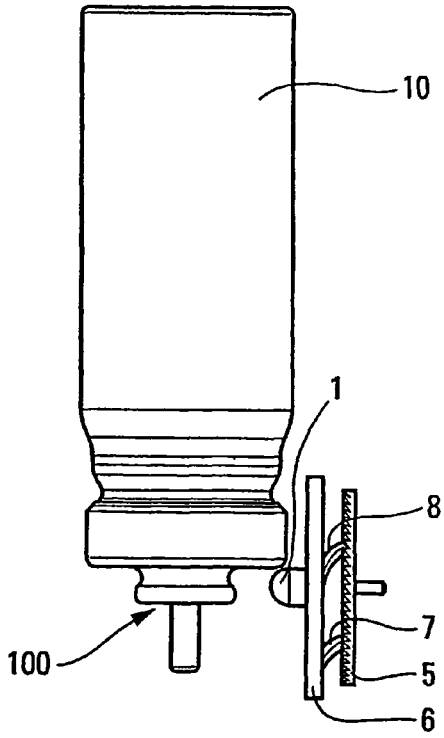
FIG. 6 is a view similar to the view in FIG. 5 of another embodiment showing an indicator assembled on the side of a reservoir.

In a second variant embodiment, shown in FIG. 6, the indicator is disposed on one side of the reservoir 10, and an actuation element secured to the drive element 6 thus transforms an axial displacement of the reservoir 10 into a radial displacement of the drive element 6, so as to cause the counter element 5 to turn. In this variant also, the actuation cycle of the indicator can begin at the beginning of the stroke of the reservoir 10, such that the indicator is actuated before any dispensing takes place.

FIGS. 21 to 36 show another embodiment of the invention, that differs from the above-described embodiments mainly in that the counter element 5 does not turn about the axial displacement axis of the actuator element 1, but about an axis that is substantially perpendicular to said axial displacement. In this embodiment, the indicator is disposed on one side, as in the variant in FIG. 6, but in this embodiment, the actuator element 1 and the drive element 6, made as a single part, are displaced axially, together with the reservoir, along a longitudinal axis of the body (and of the reservoir), so as to cause the counter element 5 to turn. The cover for closing the indicator is not shown in the figures.

Figure 22:
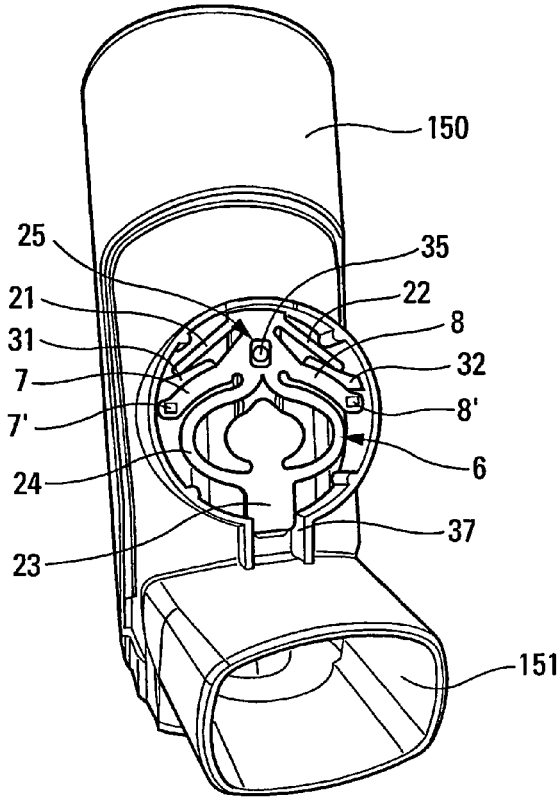
FIG. 22 is a fragmentary and diagrammatic view of a portion of the FIG. 21 indicator assembled in the body of the device.
Figure 23:
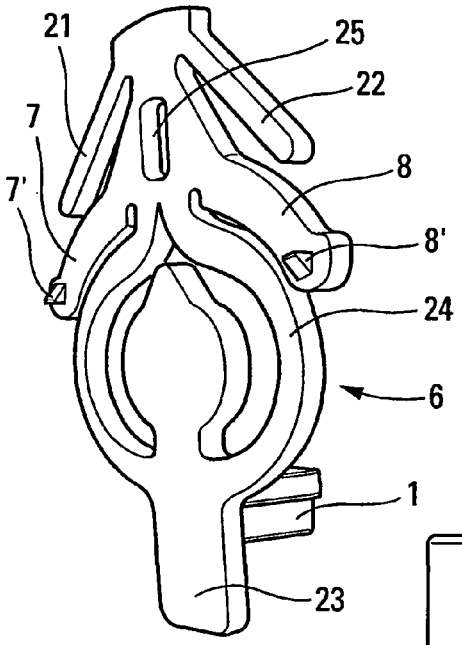
FIG. 23 is a perspective view of the drive element of the indicator of FIGS. 21 and 22.
Figure 24:
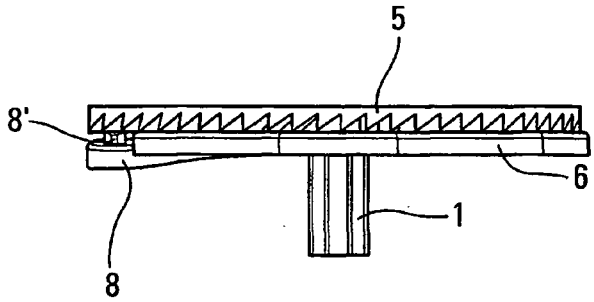
FIG. 24 is a diagrammatic plan view showing the interaction between the drive and counter elements of the indicator of FIGS. 21 to 23.
Figure 25:
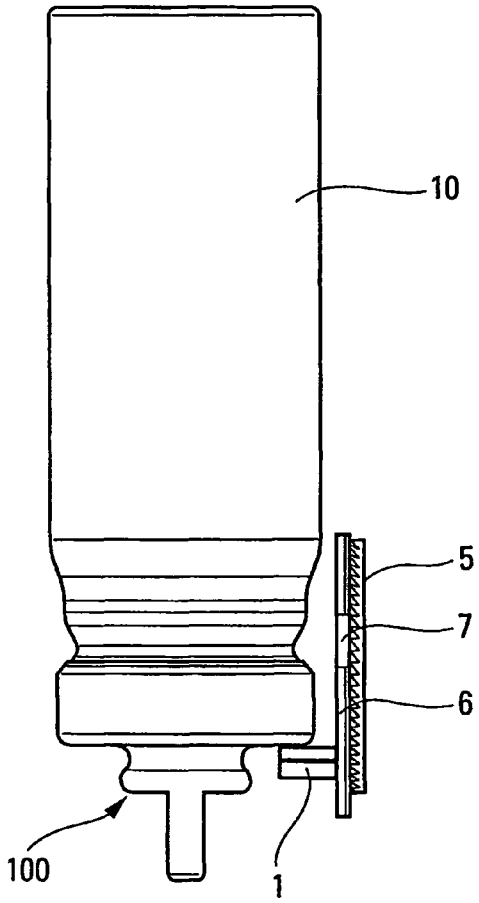
FIG. 25 is a diagrammatic side view similar to the view in FIG. 24, but also showing the reservoir.
Figures 26, 27, 28, 29, 30, 31, 32, 33, 34, 35, 36:
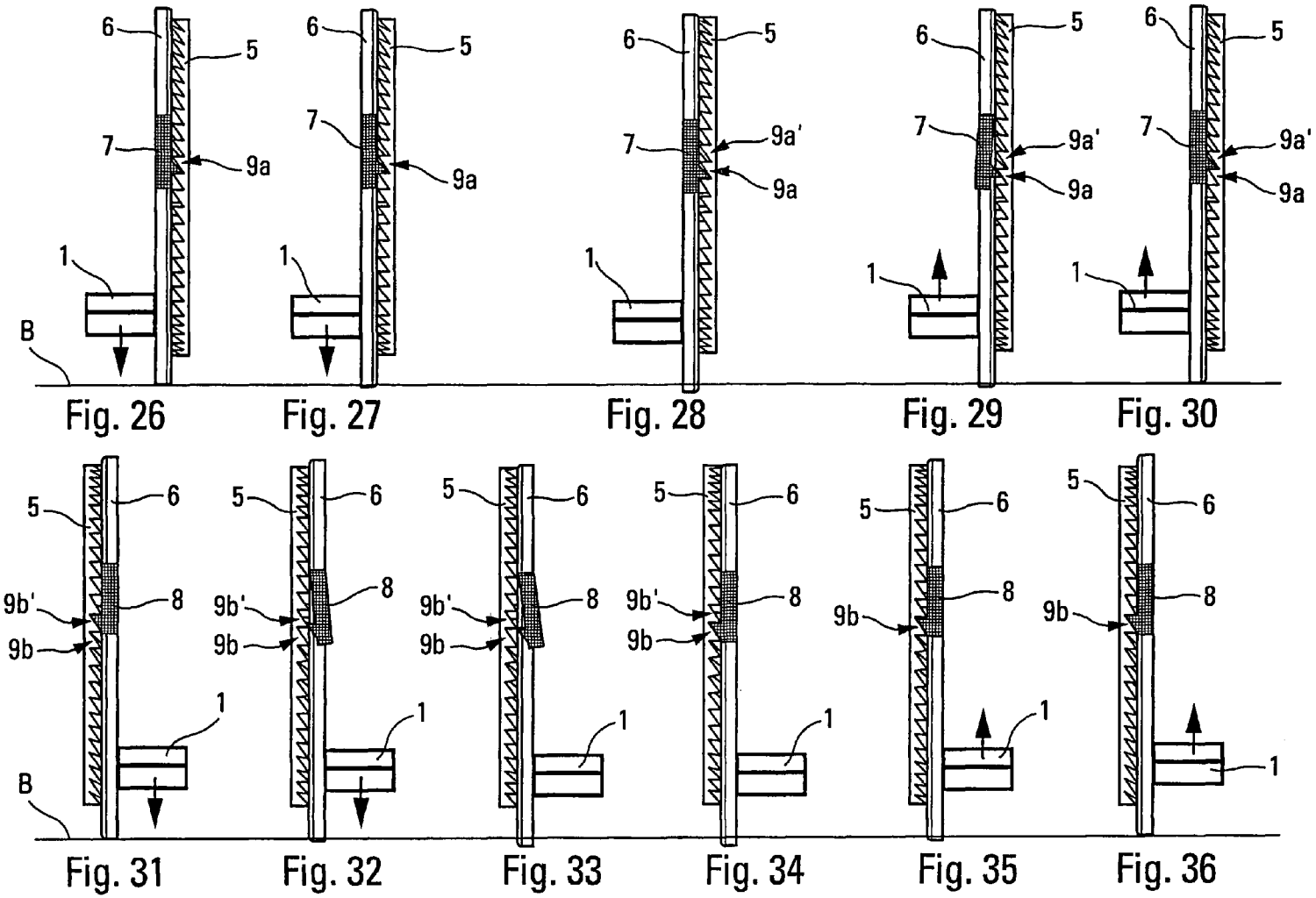

As can be seen in FIG. 22 in particular, the drive element 6 is mounted in the body 150 in axially displaceable manner. Abutment means are advantageously provided, so as to form an abutment to said axial displacement. The abutment means can comprise a pin 35 of the body 150 that can co-operate with a window 25 of the drive element 6. Other abutment means can also be envisaged. Each of the tabs 7 and 8 supports a respective tooth 7' and 8' that co-operates with the set of teeth 9 of the counter element 5. The shapes of the teeth 7' and 8' are reversed, such that the first tooth 7' pushes one of the teeth 9*a* while the reservoir 10 is descending in the body 150, and such that the second tooth 8' pulls another one of the teeth 9*b* while the reservoir 10 is rising in the body 150. This cycle is shown in FIGS. 26 to 36, and is similar to the cycle described with reference to FIGS. 7 to 17. It is therefore not described in detail below. However, it should be observed that the base line B has been shown respectively from both sides of the indicator, so as to show the axial displacement of the drive element 6 relative to the counter element 5, that remains axially stationary.

Advantageously, the flexible tabs 7 and 8 are substantially rigid axially, and are flexible only in a direction that is perpendicular to the axial displacement of the drive element 6.

The drive element 6 advantageously includes resilient means 21, 22, such as resilient blades, that co-operate with suitable shoulders 31, 32 of the body 150, so as to form a return spring for the drive element.

Preferably, the drive element 6 further includes an axially-deformable portion 24 that supports the actuator element 1. This makes it possible to continue the axial displacement of the actuator element 1 (and thus of the reservoir 10), after the abutment position defined by the pin 35 and window 25 has been reached. This makes it possible to set said abutment such that a turn of exactly one half-tooth is obtained while the reservoir is descending (while the first tooth 7' is pushing the set of teeth 9), and such that the remaining half-tooth is turned while the reservoir 10 is rising, and thus while the drive element 6 is rising under the effect of resilient means 21, 22 (while the second tooth 8' is pulling on the set of teeth 9). Since actuating the valve generally requires a greater stroke, and thus a greater axial displacement of the reservoir 10, the deformable portion 24 of the drive element 6 makes it possible to continue the axial displacement of the reservoir to the end. In addition, this system makes it possible to actuate the indicator before any dispensing begins.

Advantageously, the drive element 6 further includes an axial extension 23 that co-operates with guide means, such as a rail 37, of the body 150, and possibly with a tab of the cover (not shown), so as to guide the drive element 6 while it is being displaced and/or so as to avoid interfering displacements. Other guide means can also be envisaged.

Compared with the indicator in FIG. 6, the indicator in FIGS. 21 to 36 has the particular advantage of being thinner, thereby making it possible to reduce the outside dimensions of the device.

Advantageously, in the various variants described above, it is possible for the indicator to be actuated in two stages, a first stage before the fluid is dispensed through the dispenser orifice 151 of the body 150, and a second stage after fluid has been dispensed. Consequently, the indicator does not operate while dispensing is actually taking place, and its certain and reliable operation is thus completely independent of the way in which the user actuates the device for dispensing purposes.

Naturally, compared with the above description, the indicator could be made in a way that is different to that shown. In particular, the shapes and the positions of the first and second flexible tabs 7 and 8 could be different, providing that the first flexible tab is adapted to turn the counter element 5 by pushing it, and that the second flexible tab is adapted to turn the same counter element 5 by pulling it in the same direction of rotation. Naturally, it is also possible to envisage reversing the functions of the first and second flexible tabs 7, 8, namely that the first flexible tab 7 could pull the counter element 5, whereas the second flexible tab 8 could push it. Another advantage of the indicator of the present invention is that it includes only one element that is provided with a set of teeth, unlike numerous prior-art indicators in which two or more separate sets of teeth are provided so as to make it possible to actuate the indicator in certain and reliable manner, and so as to avoid any risk of under-counting.

Other modifications can also be envisaged by the person skilled in the art, without going beyond the ambit of the present invention, as defined by the accompanying claims.

The invention claimed is:

1. An indicator for a powder or fluid dispenser device, said indicator comprising an actuator element (1) that is axially displaceable between a rest position and an actuated position, a rotary counter element (5), and a drive element (6), said drive element (6) transforming an axial displacement of said actuator element into a rotary displacement of said counter element (5), said counter element (5) including a set of teeth (9) that co-operate with a resilient mechanism (7, 8) of said drive element (6), said resilient mechanism (7, 8) comprises at least two flexible tabs (7, 8), with at least a first flexible tab (7) co-operating with said set of teeth (9) of the counter element (5), so as to cause said counter element (5) to turn in a counting direction while the actuator element (1) is being displaced from the rest position towards the actuated position, and at least a second flexible tab (8) co-operating with said set of teeth (9) of the counter element (5), so as to cause said counter element to turn in the same counting direction while the actuator element (1) is returning from its actuated position to its rest position;

and the axis of rotation of said counter element is perpendicular to the displacement axis of said actuator element.

2. An indicator according to claim 1, in which said drive element (6) is prevented from turning relative to said actuator element (1), such that while the actuator element (1) is being displaced axially towards the actuated position, the actuator element deforms said resilient mechanism (7, 8), and while the actuator element (1) is returning axially to the rest position, said resilient mechanism returns resiliently to a non-deformed shape.

3. An indicator according to claim 1, in which the first flexible tab (7) pushes a respective tooth (9*a*) of the set of teeth of the counter element (5) on each actuation, and the second flexible tab (8) pulls on a respective tooth (9*b*) of the set of teeth (9)of the counter element (5) on each actuation.

4. An indicator according to claim 3, in which each tooth of the set of teeth (9) comprises an abutment surface, and a sloping surface, which, at one end, is connected to said abutment surface, and which, at another end, is connected to the abutment surface of the next tooth of the set of teeth (9).

5. An indicator according to claim 4, in which, while the actuator element (1) is being displaced axially towards the actuated position, the actuator element resiliently deforms said first flexible tab (7) having a free end that co-operates with a corresponding abutment surface of one of the teeth (9*a*) of the set of teeth (9), so as to turn said counter element (5) by pushing the corresponding abutment surface, said second flexible tab (8) also being resiliently deformed, with a free end sliding along the sloping surface of another one of the teeth (9*b*').

6. An indicator according to claim 4, in which, while the actuator element (1) is returning axially from the actuated position to the rest position, said second flexible tab (8) returns resiliently to a non-deformed position, with a free end of the second flexible tab co-operating with a corresponding abutment surface of the tooth (9*b*) that is situated circumferentially after the sloping surface of said other tooth (9*b*'), so as to turn said counter element (5) by pulling the corresponding abutment surface, said first flexible tab (7) also returning resiliently to a non-deformed position, with a free end of the first flexible tab sliding over the sloping surface of the said one tooth (9*a*), so as to become positioned, in the rest position of the actuator element (1), in the tooth (9*a*') that is situated circumferentially after the sloping surface of the said one tooth (9*a*).

7. An indicator according to claim 5, in which the free end of the first flexible tab (7) includes a point for pushing against the abutment surfaces of the teeth of the set of teeth (9), and the free end of the second flexible tab (8) includes a hook for pulling on the abutment surfaces of the teeth of the set of teeth (9).

8. An indicator according to claim 3, in which the teeth (9*a* and 9*b*) of the set of teeth (9) are substantially diametrally opposite around the set of teeth (9).

9. An indicator according to claim 1, in which the counter element (5) is a disk including an indicator mechanism (50) that co-operates with a viewing window (60) provided in the actuator element (1).

10. An indicator according to claim 1, in which said indicator is formed on a lateral side of a body (150) of a powder or fluid dispenser device, so as to indicate to the user the number of doses that have been dispensed or that remain to be dispensed from said reservoir (10).

11. An indicator according to claim 1, in which said first and second flexible tabs (7, 8) can flex perpendicularly to the axial displacement of said drive element (6).

12. An indicator according to claim 11, in which the drive element (6) is disposed so as to be axially displaceable in a body (150), along a longitudinal axis of said body (150), and an abutment (25,35) is provided so as to define an abutment for the axial displacement of said drive element (6).

13. An indicator according to claim 12, in which the drive element (6) includes an elastically-deformable portion (24) supporting the actuator element (1), such that said actuator element (1) is axially displaceable over a greater distance than the remainder of the drive element (6).

14. An indicator according to claim 12, in which said body (150) includes shoulders (31, 32) that co-operate with the resilient mechanism (21, 22) of the drive element (6), said resilient mechanism (21, 22) forming a return spring for the drive element (6).

15. An indicator according to claim 12, in which said indicator includes a guide (37) that co-operates with an axial extension (23) of the drive element (6), so as to guide the axial extension while the axial extension is being axially displaced relative to said body (150).

16. A powder or fluid dispenser device comprising a reservoir (10), a dispenser member (100) mounted on said reservoir (10), and a body (150) incorporating a dispenser orifice (151), said reservoir (10) being displaceable in said body (150) so as to dispense the powder or fluid, the device comprising an indicator according to claim 1.

17. A device according to claim 16, in which said indicator is fastened on a side of the body (150), with said device being actuated by the user manually exerting axial pressure on the reservoir (10), and with said indicator being actuated by said axial displacement of said reservoir (10) that co-operates with said actuator element (1) of the indicator.

18. A device according to claim 17, in which the indicator is actuated, at least in part, before any powder or fluid is dispensed by said dispenser member (100).

19. A device according to claim 18, in which a first stage of the actuation cycle of the indicator is performed before any powder or fluid is dispensed, and a second stage of the actuation cycle of the indicator is performed after powder or fluid has been dispensed, such that the indicator is not actuated while powder or fluid is being dispensed.

20. The device according to claim 16, wherein the dispenser member is a metering valve.

* * * * *